US007105761B2

(12) United States Patent
Masuda et al.

(10) Patent No.: US 7,105,761 B2
(45) Date of Patent: Sep. 12, 2006

(54) PUSH SWITCH

(75) Inventors: Masahiro Masuda, Okayama (JP); Yasunori Yanai, Okayama (JP); Yoshikazu Yagi, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/243,977

(22) Filed: Oct. 6, 2005

(65) Prior Publication Data

US 2006/0081451 A1 Apr. 20, 2006

(30) Foreign Application Priority Data

Oct. 20, 2004 (JP) ..... 2004-305471

(51) Int. Cl.
*H01H 13/48* (2006.01)
*H01H 5/30* (2006.01)
*H01H 1/10* (2006.01)

(52) U.S. Cl. ..... 200/406; 200/516

(58) Field of Classification Search .... 200/16 R–16 D, 200/406, 512–517, 520, 341, 345
See application file for complete search history.

(56) References Cited

U.S. PATENT DOCUMENTS

| | | | | |
|---|---|---|---|---|
| 5,199,557 | A * | 4/1993 | Brandt et al. | 200/406 |
| 5,403,984 | A * | 4/1995 | Ogawa | 200/517 |
| 5,772,010 | A * | 6/1998 | Watanabe et al. | 200/406 |
| 6,107,586 | A * | 8/2000 | Takeuchi et al. | 200/520 |
| 6,664,491 | B1 * | 12/2003 | Yanai et al. | 200/516 |
| 6,670,566 | B1 * | 12/2003 | Wang | 200/406 |
| 6,774,330 | B1 * | 8/2004 | Blossfeld et al. | 200/406 |
| 6,894,240 | B1 * | 5/2005 | Komoto et al. | 200/406 |

FOREIGN PATENT DOCUMENTS

JP 10-092260 4/1998

* cited by examiner

*Primary Examiner*—Michael A. Friedhofer
(74) *Attorney, Agent, or Firm*—Wenderoth, Lind & Ponack, L.L.P.

(57) ABSTRACT

A push switch includes a case having a bottom face, first and second fixed contacts provided on the bottom face of the case, a movable contact made of metal thin plate, an elastic body, and an operating body. The elastic body includes a cylindrical portion having a hole formed therein, a conical portion provided below the cylindrical portion, a projection located above the movable contact, and a junction portion coupling the projection to the cylindrical portion. This push switch can provide a long over-stroke after being turned on.

7 Claims, 9 Drawing Sheets

PUSH SWITCH

FIELD OF THE INVENTION

The present invention relates to a push switch for use in an input section of various electronic devices.

BACKGROUND ART

With recent downsizing and improvement in quality of electronic devices, electronic components used in the electronic devices, such as a push switch, are required to be small and to provide less strain and good feel to fingers during operation. A push switch is required to be able to be pushed after being turned on, that is, to have a stroke after turning on (hereinafter referred to as "an over-stroke") in addition to an operation stroke until the switch is turned on (herein after referred to as "an on-stroke"), providing a long operation stroke and a good operation feel.

FIG. 7 is a front cross-sectional view of a conventional push switch disclosed in Japanese Patent Laid-Open Publication No. 10-92260. FIG. 8 is an exploded perspective view of the switch. Columnar caulking projection 1A is provided at each corner of the top surface of box-shaped case 1 made of insulating resin. Central fixed contact 2 coupled to connection terminal 2A and two outer fixed contacts 3 coupled to connection terminal 3A are fixed on the inner bottom face of case 1 by insert molding. Movable contact 4 made of resilient thin metal plate is mounted on outer fixed contacts 3.

Movable contact 4 has outer periphery 4A having a annular ring shape, and tongue 4B extending from outer periphery 4A to the center of the ring shape. Tongue 4B is coupled to outer periphery 4A at junction portion 4C. Tongue 4B is bent at junction portion 4C to incline upward. Outer periphery 4B of movable contact 4 is mounted on outer fixed contacts 3 to electrically contact fixed contacts 3. Tongue 4B faces central fixed contact 2 by a predetermined clearance between tongue 4B and fixed contact 2, providing a switch contact.

Elastic body 5 made of elastic material, such as elastomer, has rod portion 5A at the upper part of body 5, and conical portion 5B at the lower part of body 5. Conical portion 5B which is hollow and thin has an opening which opens downward. Elastic body 5 further has projection 5C projecting downward from the center of conical portion 5B opening downward. Projection 5C faces tongue 4B of movable contact 4 by a predetermined clearance between projection 5C and tongue 4B. Lower end 5D of conical portion 5B is mounted on outer periphery 4A of movable contact 4.

Cylindrical operating body 6 made of insulating resin is mounted on rod like portion 5A of elastic body 5 and has an opening at the lower part of body 6. Operating body 6 includes operating portion 6D, i.e. the upper part of the operating body, sidewall portion 6A extending downward from operating portion 6D, engaging portions 6B protruding outward from sidewall portion 6A, and stopper claws 6C projecting from the lower end of sidewall portion 6A. Each of engaging portions 6B has a predetermined width and extends vertically. Each of stopper pawls 6C projects from a position different from engaging portion 6B at the end of sidewall portion 6A.

Cylindrical cover 7 made of insulating resin has through-hole 7A formed therein. Operating portion 6D, i.e. the upper part of operating body 6, projects upward thorough through-hole 7A. Cover 7 has notches 7B in the lower part of cover 7. Each of notches 7B is engaged with a corresponding projection 1A and attached to case 1.

Grooves 7C extending vertically are formed in the inner wall of cover 7. Engaging portions 6B of operating body 6 are inserted into grooves 7C. Engaging portions 6B are engaged with grooves 7C to allow operating body 6 to be guided to be movable upward and downward smoothly without rattling. In an ordinary status shown in FIG. 7, stopper claws 6C of operating body 6 are engaged with the inner surface of the top face portion of cover 7 around through-hole 7, preventing operating body 6 from dropping thorough through-hole 7A.

Recesses 7D opening inside are formed in portions of the sidewall of cover 7 below stopper claws 6C and extend in vertical directions in which stopper claws 6C are positioned. Each recess 7D receives a stopper claw 6C positioned therein to allow claw 6C to be movable in recess 7D when operating body 6 moves downward. The sidewalls of recesses 7D guide stopper claws 6C. Grooves 7C and recesses 7D restrict engaging portions 6B and stopper claws 6C to be movable only upward and downward, respectively, thereby preventing operating body 6 from rotating or dropping out upward.

An operation of the conventional push switch will be described below.

When operating portion 6D in a turned-off status shown in FIG. 9 is pushed with operating force F1, operating body 6 presses elastic body 5 downward direction D1, thereby causing conical portion 5B of elastic body 6 to deform. Upon deforming, conical portion 5B provides a light click feel, and simultaneously to this, projection 5C of elastic body 5 in a presses tongue 4B downward. This action causes the bottom face of tongue 4B to contact central fixed contact 2, thus establishing electrical connection between central fixed contact 2 and outer fixed contacts 3, that is, between connection terminals 2A and 3A.

When the pressing force applied to operating portion 6D is removed, elastic body 5 and movable contact 4 return to their original shapes shown in FIG. 7 by their own restoring force. Thus, the electrical connection between connection terminals 2A and 3A is broken.

FIG. 10 shows a relation between the operation stroke and operating force F1 in downward direction D1, in which the vertical axis represents the operation stroke, and the horizontal axis represents operating force F1. The switch is turned on when the operation stroke reaches point P. In other words, range A1 where the operation stroke ranges from 0 to point P is the on-stroke. The switch is turned on in a portion where the operation stroke exceeds point P.

The conventional push switch has no portion which deforms further after conical portion 5B of elastic body 5 deforms to cause the switch to be turned on. In other words, as shown in FIG. 10, the switch provides almost no operation stroke in range A2 where the operation stroke exceeds point P, not providing a long over-stroke.

SUMMARY OF THE INVENTION

A push switch includes a case having a bottom face, first and second fixed contact provided on the bottom face of the case, a movable contact made of metal thin plate, an elastic body, and an operating body. The elastic body includes a cylindrical portion having a hole formed therein, a conical portion provided below the cylindrical portion, a projection located above the movable contact, and a junction portion coupling the projection to the cylindrical portion.

This push switch can provide a long over-stroke after turned on.

DETAILED DESCRIPTION OF THE PREFERRED EMBODIMENT

Figure 1:
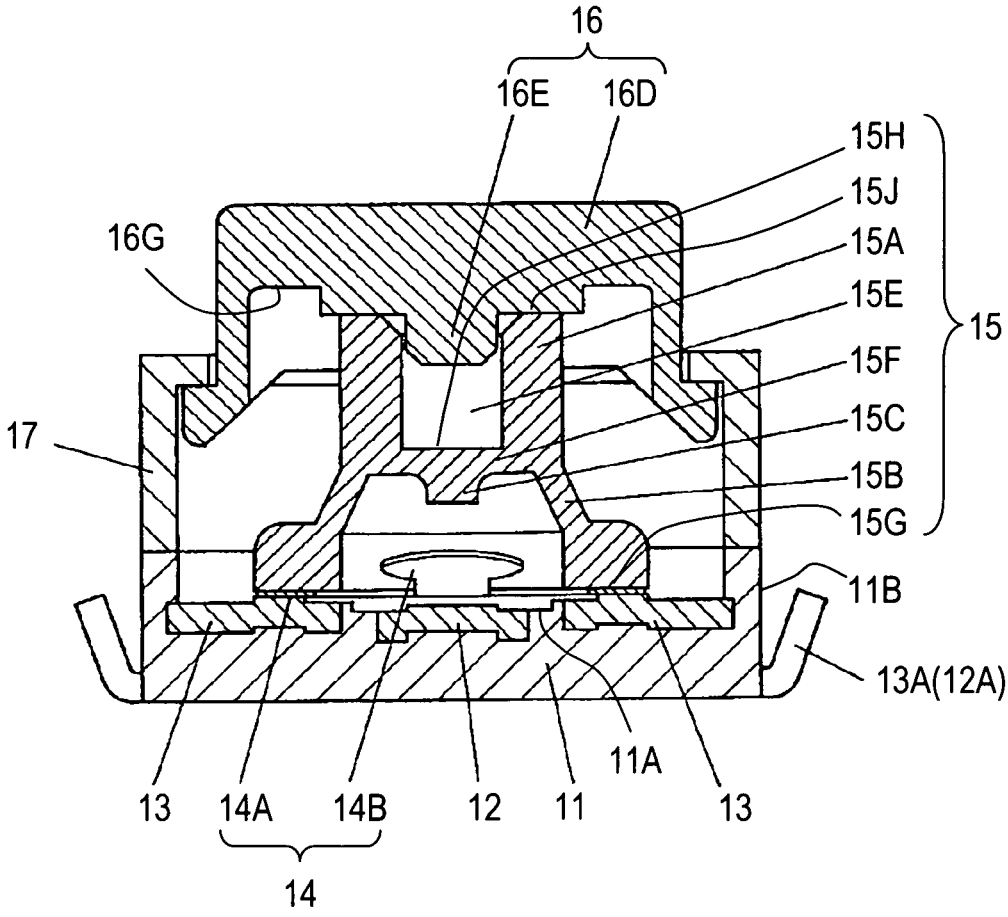
FIG. 1 is a front cross sectional view of a push switch in accordance with an exemplary embodiment of the present invention.
Figure 2:
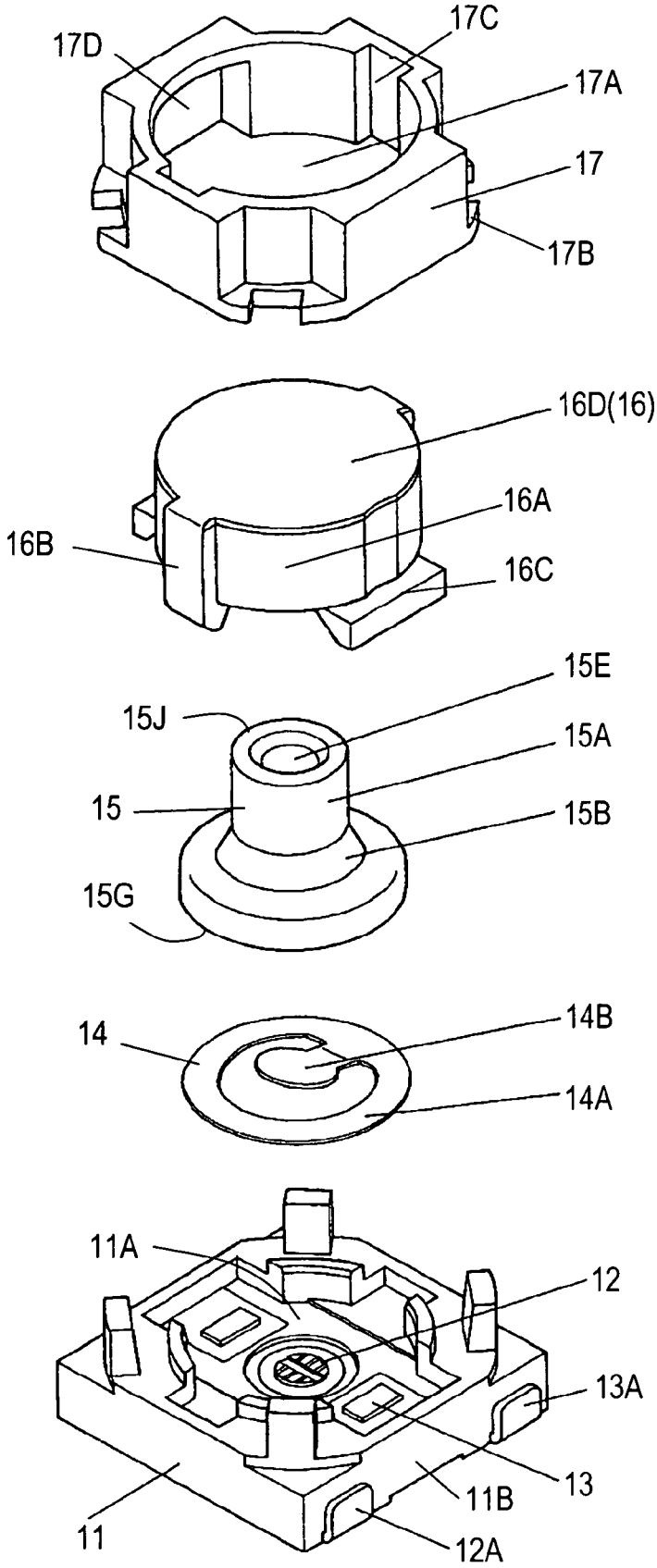
FIG. 2 is an exploded perspective view of the push switch in accordance with the embodiment.

FIG. 1 is a front cross sectional view of a push switch in accordance with an exemplary embodiment of the present invention. FIG. 2 is an exploded perspective view of the push switch. Fixed contact 12 and two fixed contacts 13 expose and fixed on bottom face 11 A of box-shaped case 11 made of insulating resin by insert molding. Two fixed contacts 13 allowing movable contact 14 to be between contacts 13 are located symmetrically to each other about movable contact 14. Connection terminal 12A connected with fixed contact 12 and connection terminal 13A connected with fixed contacts 13 project from sidewall 11B of case 11.

Movable contact 14 made of resilient thin metal plate has outer periphery 14A having an annular ring shape, and tongue 14B projecting from outer periphery 14A toward the center of outer periphery 14A. Tongue 14B is bent to incline against outer periphery 14A, and faces fixed contact 12 by a predetermined clearance between tongue 14B and fixed contact 12. Outer periphery 14A is mounted on fixed contacts 13.

Elastic body 15 made of elastic material, such as elastomer, has cylindrical portion 15A at the upper part of body 15, and conical portion 15B at the lower part of body 15. Conical portion 15B which is hollow has an opening which opens downward. Lower end 15G of conical portion 15B is mounted on outer periphery 14A of movable contact 14. Operating body 16 made of insulating resin is located on top surface 15J of cylindrical portion 15A.

Figure 7:
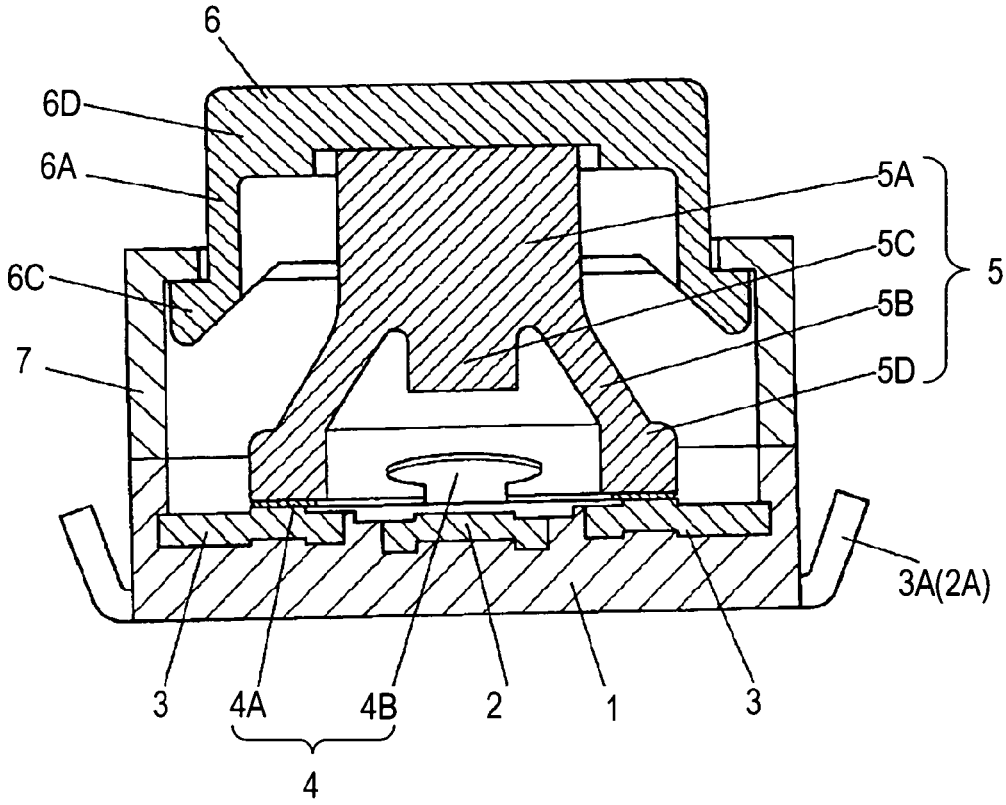
Fig. 7 Prior Art
FIG. 7 is a front cross sectional view of a conventional push switch.
Figure 8:
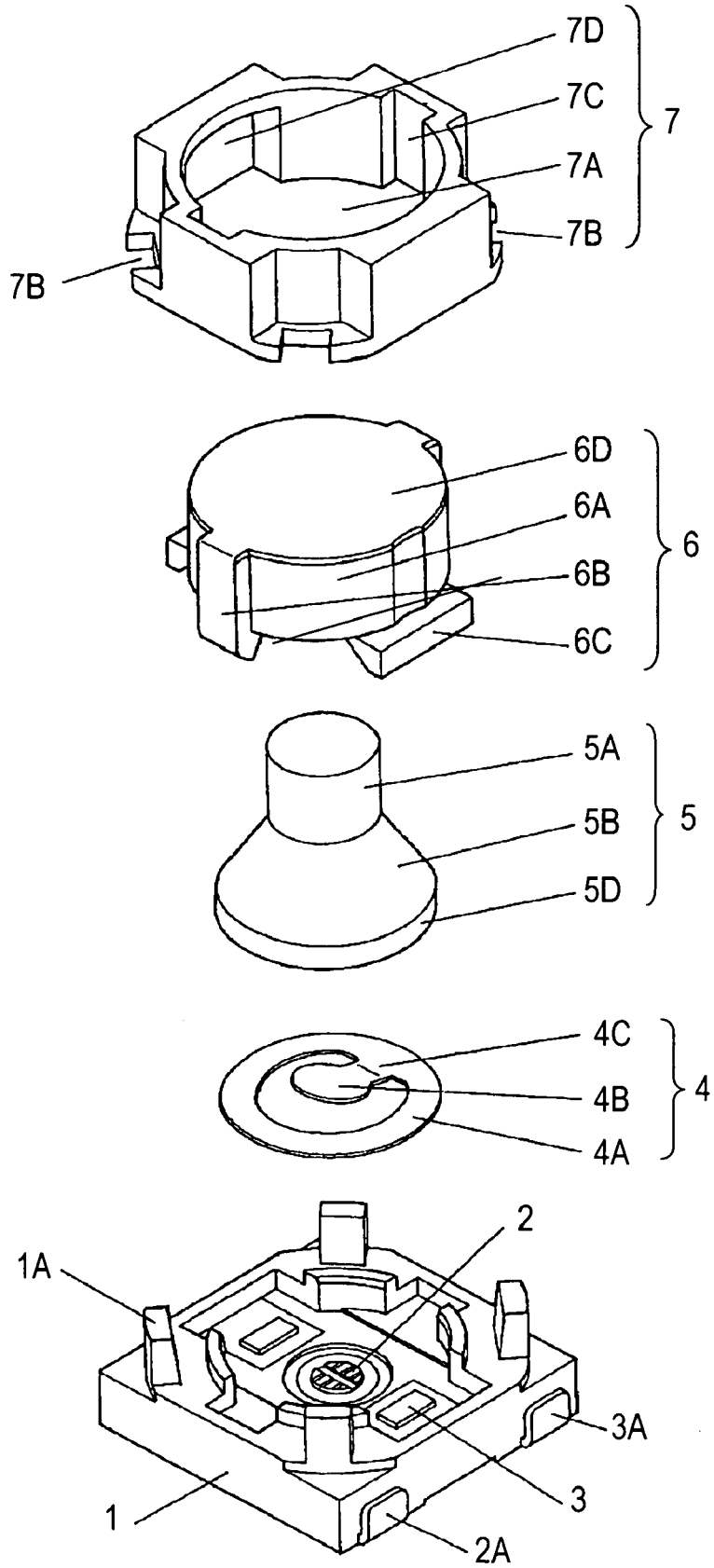
Fig. 8 Prior Art
FIG. 8 is an exploded perspective view of the conventional push switch.
Figure 9:
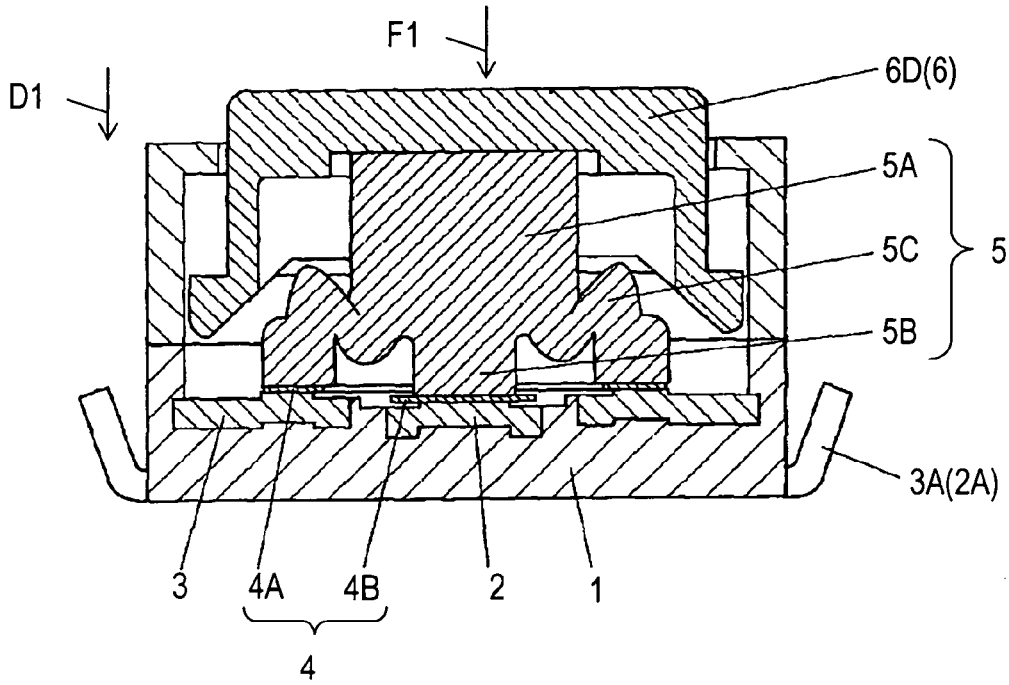
Fig. 9 Prior Art
FIG. 9 is a front cross sectional view of the conventional push switch activated.
Figure 10:
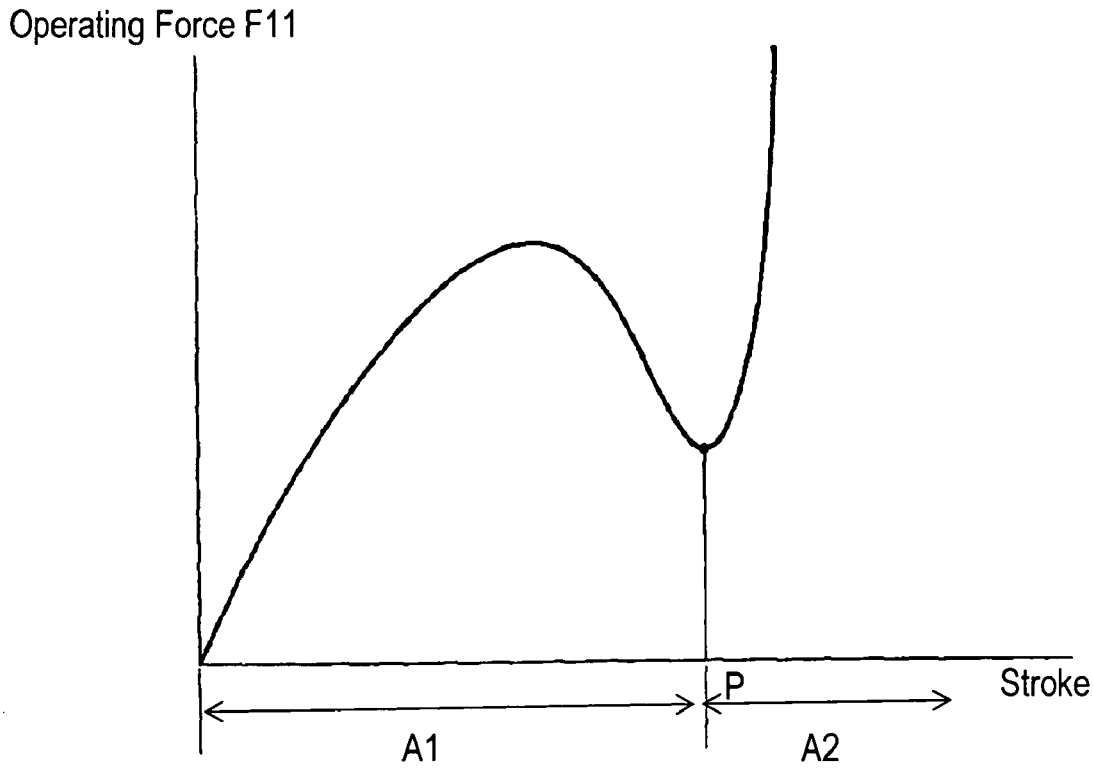
Fig. 10 Prior Art
FIG. 10 shows a relation between an operation stroke and an operating force of the conventional push switch.

Cover 17 having a substantially-cylindrical shape made of insulating resin is fixed to case 11, and has through-hole 17A formed therein. Operating portion 16D of operating body 16 projects through through-hole 17A. Cover 17 supports operating body 16 to allow operating body 16 to be movable upward and downward. Similarly to operating body 6 and cover 7 shown in FIG. 7, stopper claws 16C projecting from the lower end of sidewall 16A of operating body 16 contact the lower face of a top portion of recesses formed in cover 17 around through-hole 17A. This structure prevents operating body 16 from rotating and dropping out of through-hole 17A of cover 17 upward.

Cylindrical portion 15A at the upper part of elastic body 15 has hole 15E formed therein that opens substantially at the center of top surface 15J. Hole 15E has bottom 15H. Elastic body 15 has projection 15C located at the open center of conical portion 15B and projecting toward fixed contact 12. Projection 15C faces tongue 14B of movable contact 14 by a predetermined clearance between projection 15C and tongue 14B, and is positioned above fixed contact 12. Projection 15C is coupled to cylindrical portion 15A with junction portion 15F at bottom 15H of hole 15E.

Figure 3:
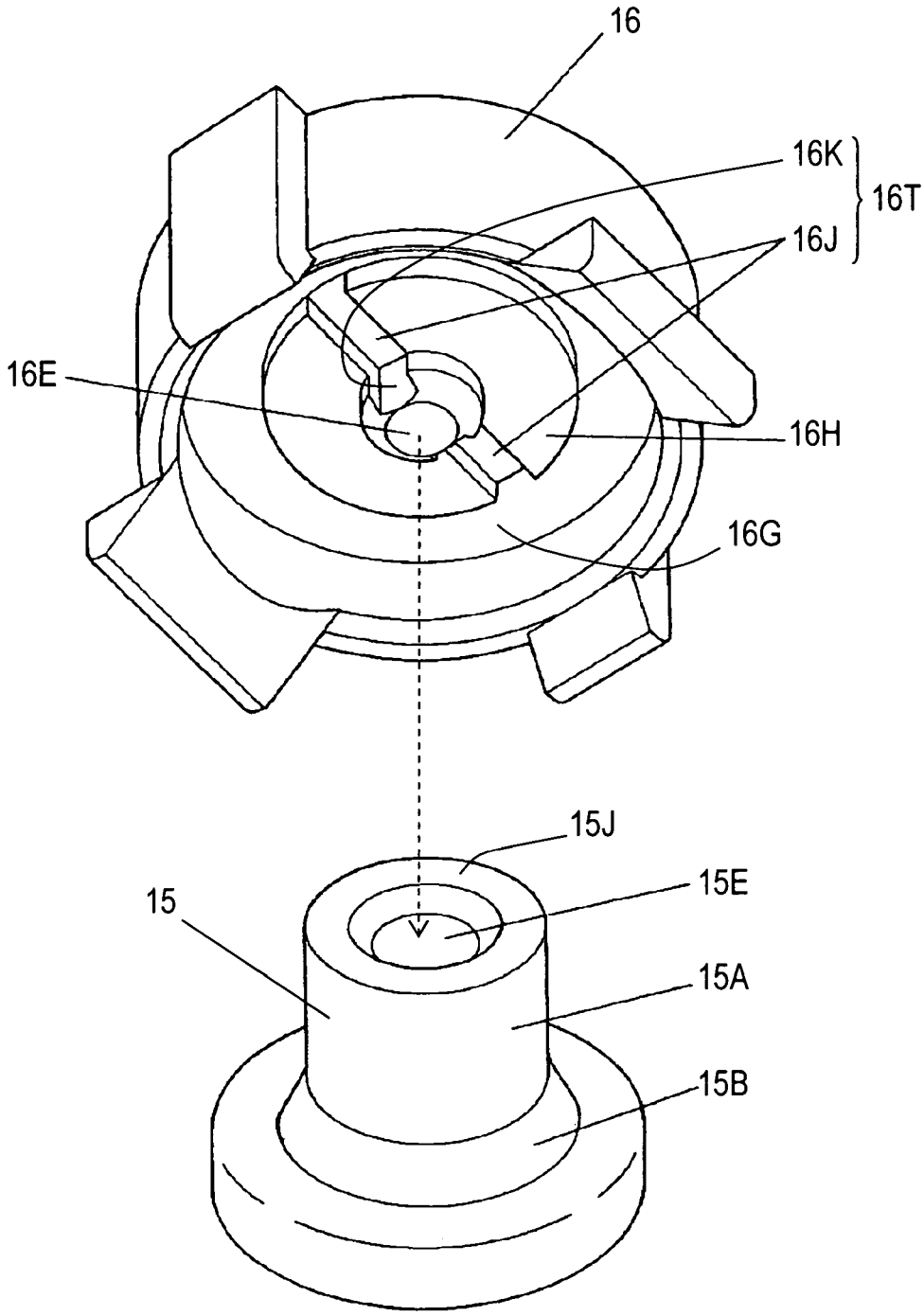
FIG. 3 is perspective view of an operating body and an elastic body of the push switch in accordance with the embodiment.

FIG. 3 is a perspective view of operating body 16 and elastic body 15.

Operating body 16 has circular pedestal 16H provided on bottom face 16G of operating portion 16D. Circular pedestal 16H has a diameter larger than the outer diameter of cylindrical portion 15A. Protrusion 16E, which is to be inserted into hole 15E of elastic body 15 protrudes from the center of circular pedestal 16H. Circular pedestal 16H contacts top surface 15J of cylindrical portion 15A of elastic body 15. Protrusion 16 is inserted to reach a middle portion of hole 15E. Two grooves 16K communicating with hole 15E of elastic body 15, are formed in protrusion 16E. Two channels 16J extending from grooves 16K to the outside of cylindrical portion 15A of elastic body 15 are formed in circular pedestal 16H. Two grooves 16K and two channels 16J provide two channels 16F allowing hole 15E to communicate with the outside of cylindrical portion 15A. Two channels 16F are located symmetrically to each other about protrusion 16E.

Figure 4:
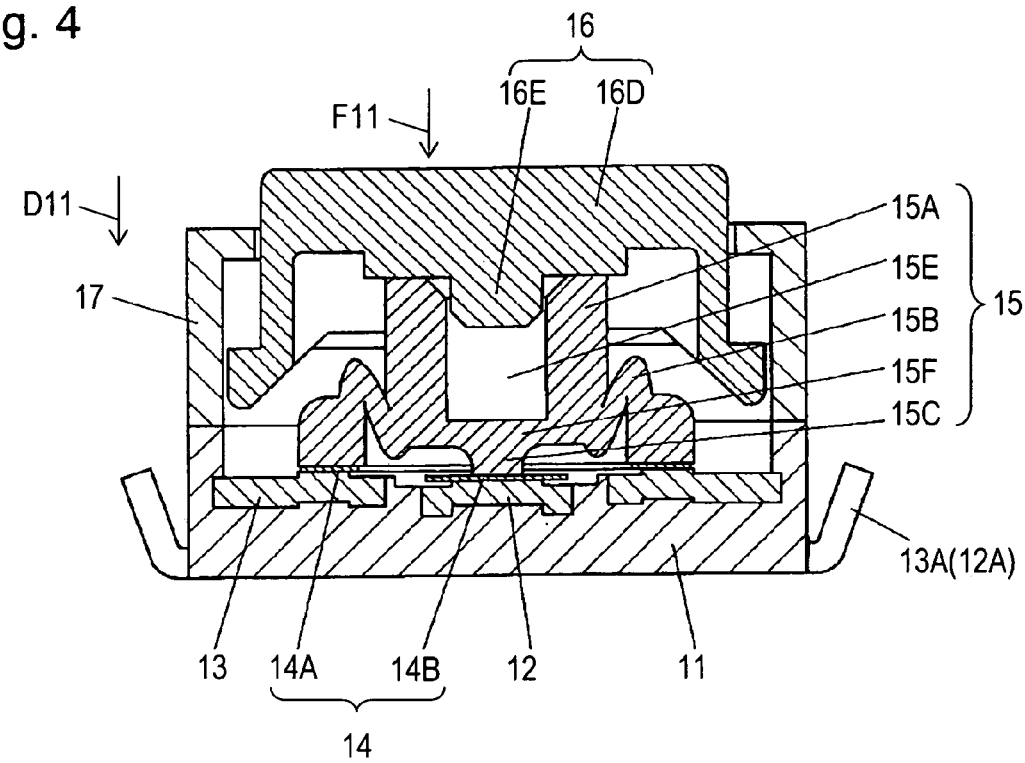
FIG. 4 is a front cross sectional view of the push switch activated in accordance with the embodiment.
Figure 5:
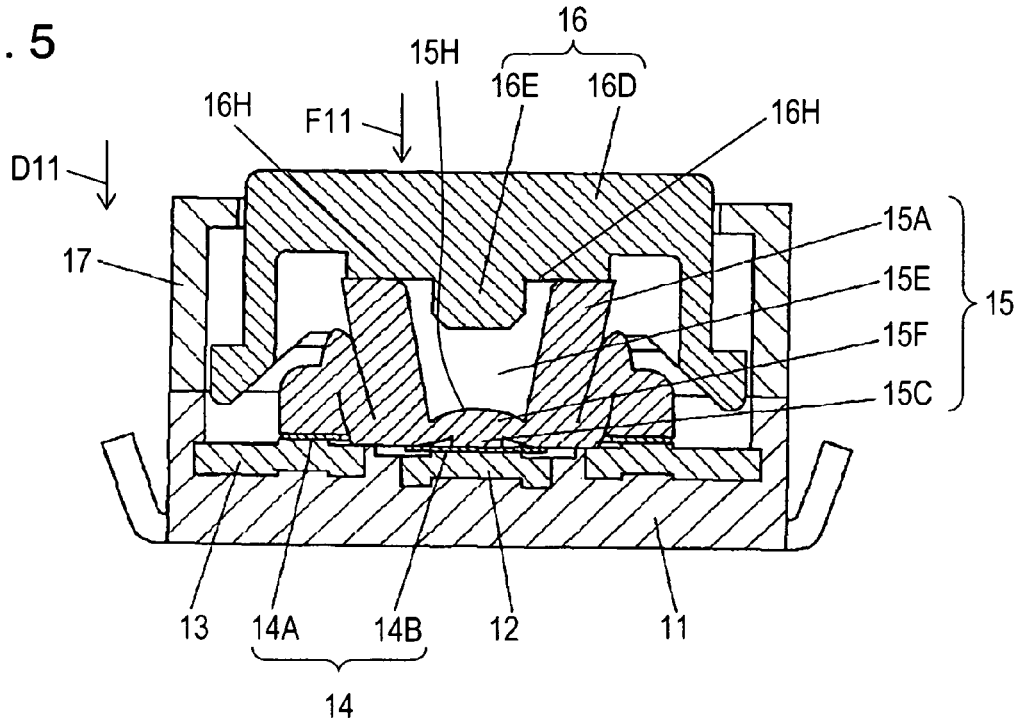
FIG. 5 is a front cross sectional view of the push switch activated in accordance with the embodiment.
Figure 6:
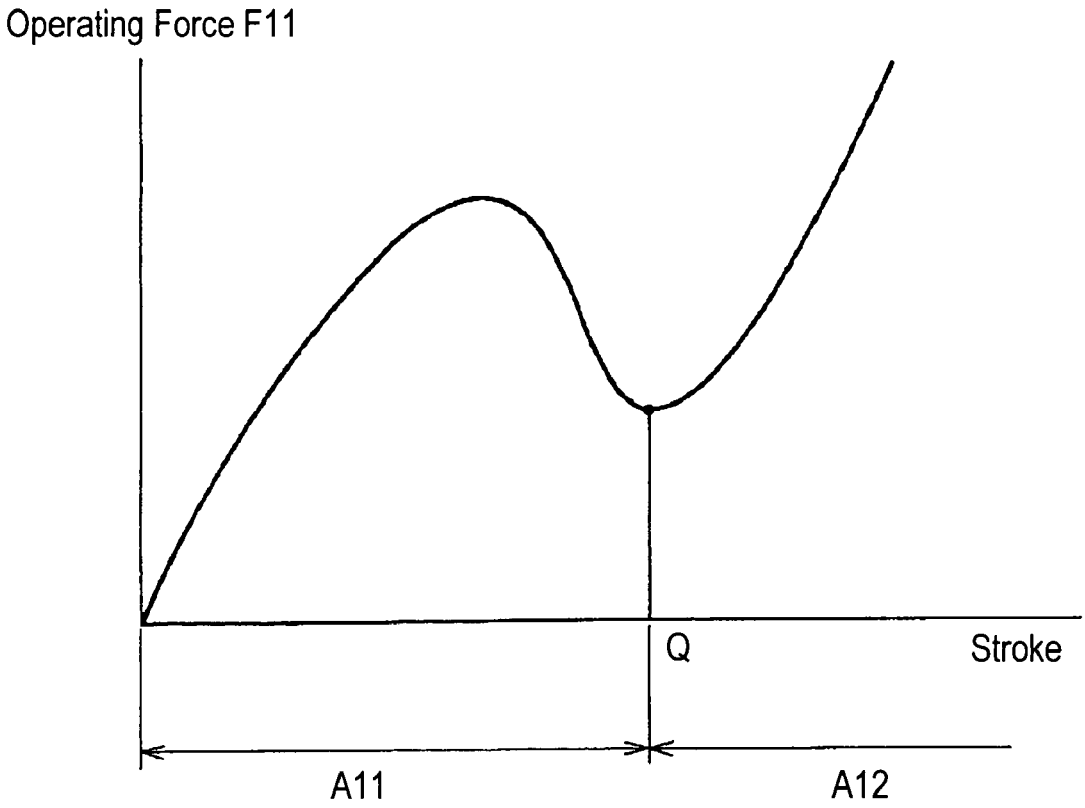
FIG. 6 shows a relation between an operation stroke and an operating force of the push switch in accordance with the embodiment.

An operation of the push switch of this embodiment will be described below. FIGS. 4 and 5 are cross sectional views of the push switch activated of this embodiment. FIG. 6 shows a relation between an operation stroke and operating force F11 in a downward direction D11 of the push switch of this embodiment, in which the vertical axis represents operating force F11, and the horizontal axis represents an operation stroke.

First, operating portion 16D of operating body 16 in an ordinary status where no operating force is applied as shown in FIG. 41 that is in a position where the operation stroke is zero, is pushed with operating force F11. Then, as shown in FIG. 4, conical portion 15B of elastic body 15 deforms at a position where the operation stroke becomes point Q, as shown in FIG. 6. Upon deforming, conical portion 15B provides a light click feel, and projection 15C of elastic body 15 presses tongue 14B of movable contact 14. Next, projection 15C causes tongue 14B to contact fixed contact 12, thereby establishing electrical connection between fixed contacts 13 and fixed contact 12, i.e., between connection terminals 12A and 13A, turning on the switch. In elastic body 15, the thickness of conical portion 15B and the thickness of junction portion 15F coupling projection 15C to cylindrical portion 15A are determined so that conical portion 15B deforms elastically before junction portion 15F deforms elastically. Range A11 where the operation stroke ranges from 0 to point Q corresponds to an on-stroke of the switch.

Protrusion 16E of operating body 16 is inserted into hole 15E formed in cylindrical portion 15A of elastic body 15. This arrangement prevents cylindrical portion 15A from deforming even when operating force F11 is applied to cylindrical portion 15A, thus preventing operating body 16 from being displaced with respect to cylindrical portion 15A. This structure provides a good and stable operation feel of the switch.

Next, operating potion 16D is further depressed in downward direction D11 with increased operating force F11 in the status shown in FIG. 4 where the switch is turned on. Then, as shown in FIG. 5, junction portion 15F coupling projection 15C to cylindrical portion 15A elastically deforms to have a dome shape allowing bottom 15H to protrude upward. When operating force F11 is further increased, cylindrical portion 15A elastically deforms so that hole 15E flares toward top surface 15J. At this moment, top surface 15J of cylindrical portion 15A having hole 15E deforming to flare upward does not come out of circular pedestal 16H of operating body 16. Thus, respective ends of channels 16K (16F) provided in circular pedestal 16H are not covered with elastic body 15. The thickness of junction portion 15F and the thickness of cylindrical portion 15A are determined so that junction portion 15F deforms before cylindrical portion 15A deforms.

As described above, even after conical portion 15B of elastic body 15 deforms to turn on the switch, junction portion 15F and cylindrical portion 15A elastically deform. This structure provides a pressing allowance, i.e., a long over-stroke, with which the switch can be pressed further with increased operating force F11, hence providing the switch with good operation feel. Range A12 where the operation stroke exceeds point Q corresponds to the over-stroke.

Two channels 16F formed in circular pedestal 16H of operating body 16 and allowing hole 15E of elastic body to communicate with the outside of cylindrical portion 15A are located symmetrically to each other about protrusion 16E. These channels prevent central hole 15E from being covered with operating body 16. Thus, air inside of hole 15E passes through channels 16F, and hence, does not produce compressive repellent force, thus providing the push switch with a good operation feel.

Then, when operating force F11 applied to operating body 16 is removed, junction portion 15F and cylindrical portion 15A of elastic body 15 return to the status shown in FIG. 4 by their own restoring force. Further, circular-conical portion 15B of elastic body 15 which deforms and tongue 14B of movable contact 14 return to the status shown in FIG. 1 by their own restoring force, thus breaking the electrical connection between connection terminals 12A and 13A to turn off the push switch. The return operations from the status shown in FIG. 5 to FIG. 1 via FIG. 4 are performed in series smoothly.

What is claimed is:

1. A push switch comprising:

a case made of insulating resin and having a bottom face;

a first fixed contact provided on the bottom face of the case;

a second fixed contact provided on the bottom face of the case;

a movable contact made of metal thin plate, including an annular outer periphery located on the first fixed contact, and a tongue extending from the outer periphery to a center of the annular portion, the tongue being located over the second fixed contact and facing the second fixed contact across a predetermined clearance between the tongue and the second fixed contact;

an elastic body including a cylindrical portion having a hole formed therein, the cylindrical portion having a top surface, the hole opening to the top surface of the cylindrical portion, the hole having a bottom, a conical portion provided below the cylindrical portion, the conical portion being hollow to open downward, the conical portion having a lower end located on the outer periphery of the movable contact, a projection located above the tongue of the movable contact, the projection projecting from a center of the opening of the conical portion and under the bottom of the hole, and a junction portion coupling the projection to the cylindrical portion; and an operating body mounted on the top surface of the cylindrical portion of the elastic body, the operation body being movable upward and downward, wherein the conical portion, the junction portion and the operating body are configured such that when the operating body is moved downward during an operation stroke, the conical portion and the junction portion deform, and the conical portion deforms before the junction portion deforms.

2. The push switch of claim 1, wherein the operating body includes a protrusion inserted into the hole of the cylindrical portion of the elastic body.

3. The push switch of claim 1, wherein the operating body has a channel formed therein, and the channel allows the hole of the cylindrical portion communicate with an outside of the cylindrical portion of the elastic body.

4. The push switch of claim 1, wherein respective thicknesses of the conical portion and the junction portion are such that the conical portion and the junction portion are configured so that the conical portion deforms before the junction portion deforms when the operating body is moved downward during the operation stroke.

5. The push switch of claim 1, wherein the conical portion, the junction portion, the projection and the movable contact are configured such that when the conical portion deforms during the operation stroke, the projection presses the tongue of the movable contact into contact with the second fixed contact to establish an electrical connection, and the junction portion deforms after the electrical connection is established.

6. The push switch of claim 1, wherein the conical portion, the junction portion, the cylindrical portion and the operating body are configured such that during the operation stroke, the cylindrical portion deforms after the junction portion deforms.

7. The push switch of claim 6, wherein the conical portion, the junction portion, the cylindrical body, the projection and the movable contact are configured such that when the conical portion deforms during the operation stroke, the projection presses the tongue of the movable contact into contact with the second fixed contact to establish an electrical connection, and the junction portion and the cylindrical portion deform after the electrical connection is established.

* * * * *